US005404843A

United States Patent [19]

Kato

[11] Patent Number: 5,404,843

[45] Date of Patent: Apr. 11, 1995

[54] FUEL INJECTION DEVICE FOR MULTI CYLINDER TWO STROKE ENGINE

[75] Inventor: Masahiko Kato, Hamamatsu, Japan

[73] Assignee: Sanshin Kogyo Kabushiki Kaisha, Hamamatsu, Japan

[21] Appl. No.: 139,985

[22] Filed: Oct. 21, 1993

[30] Foreign Application Priority Data

Oct. 21, 1992 [JP] Japan ..... 4-305903

[51] Int. Cl.[6] ..... F02M 51/00

[52] U.S. Cl. ..... 123/73 B; 123/688; 123/494

[58] Field of Search ..... 123/73 A, 73 B, 73 C, 123/478, 688, 494

[56] References Cited

U.S. PATENT DOCUMENTS 4,461,260 7/1984 Nonaka et al. ..... 123/73 A
4,958,516 9/1990 Stiles et al. ..... 123/478
5,051,909 9/1991 Gomez et al. ..... 123/73 C
5,127,373 7/1992 Mochizuki et al. ..... 123/478
5,134,984 8/1992 Nonaka et al. ..... 123/478
5,146,899 9/1992 Tanaka et al. ..... 123/478

*Primary Examiner*—David A. Okonsky
*Attorney, Agent, or Firm*—Knobbe, Martens, Olson & Bear

[57] ABSTRACT

A system for controlling the supply of fuel to a multiple cylinder, two cycle, crankcase compression, internal combustion engine wherein air flow is normally measured by a pressure sensor in the crankcase chamber of only one of the cylinders. When an abnormal condition is sensed, the supply of fuel to the cylinder associated with the pressure sensor is discontinued and in some embodiments, the control of the fuel to the other cylinders is accomplished by means other than pressure sensing.

30 Claims, 3 Drawing Sheets

FUEL INJECTION DEVICE FOR MULTI CYLINDER TWO STROKE ENGINE

BACKGROUND OF THE INVENTION

This invention relates to a charge forming device and control therefore for a multi cylinder, two stroke internal combustion engine and more particularly to an improved fuel injection device and control therefore.

It has been recognized that there is a need for providing more accurate control of the amount of fuel supplied to an engine. Obviously, operating with the optimum amount of fuel will insure not only good fuel economy, but also reduce exhaust gas emissions. Thus, it is important to control the air/fuel ratio supplied to an engine as accurately as possible and this requires some method of accurately measuring the amount of air consumed by the engine.

It has been recognized that with two cycle, crankcase compression, internal combustion engines, pressure variations in the crankcase chamber can provide an accurate indication of the air being consumed by the engine. That is, by comparing the pressure in the crankcase chamber adjacent the times of opening and closing of the scavenge port, it is possible to determine the amount of air flowing to the cylinder in each cycle. Thus, such pressure sensing air measuring devices are extremely effective in providing good fuel economy and good exhaust emission control.

With a two cycle engine, however, there is fairly substantial overlap between the opening of the scavenging port and the closing of the exhaust port. Therefore, there exist a possibility that some of the burning charge from the cylinder can enter into the crankcase chamber and adversely effect not only the pressure reading of the pressure sensor but can actually damage the pressure sensor.

Where multiple cylinder engines are employed, it is generally the practice to only sense the pressure in one crankcase chamber in order to measure the air flow. This assumes that the air flow to all of the cylinders is either substantially equal or adjustments may be made in the amount of fuel supplied depending upon the physical orientations of the cylinders from known variations from cylinder to cylinder. Hence, if the single sensor that is used gives an erroneous reading, all cylinders will be affected.

It is, therefore, a principal object to this invention to provide an improved method and apparatus for sensing the air flow to an internal combustion engine for controlling its fuel supply.

It is a further object to this invention to provide an improved method and apparatus for crankcase pressure sensing and in which the device accommodates conditions when the pressure sensor may not give an accurate signal.

It is a further object to this invention to provide an improved method and apparatus for protecting the crankcase pressure sensor of a two stroke, crankcase compression internal combustion engine.

It is a further object to this invention to provide a method and apparatus for controlling the amount of fuel supplied to a two stroke, internal combustion engine through the sensing of the pressure in only one of multiple crankcase chambers and also which affords an alternate control routine under circumstances when the pressure signals may not be accurately indicative of actual air flow to the engine.

SUMMARY OF THE INVENTION

All of the features of the invention are adapted to be embodied in a two stroke, multi cylinder, crankcase compression, internal combustion engine having a cylinder block with at least two cylinder bores and a crankcase that is associated with the cylinder block. The crankcase has two crankcase chambers sealed from each other and each of which is associated with a respective one of the cylinder bores. Charge forming means are provided for supplying a charge to the cylinders. A crankcase pressure sensor is associate with only one of the crankcase chambers for sensing the pressure therein and means is responsive to the output of the crankcase pressure sensor for controlling the amount of fuel supplied to each of the cylinder bores. Abnormal condition sensing means are providing for sensing an abnormal condition which may affect the operation of the pressure sensor.

In accordance with an apparatus embodying the invention, means are providing for discontinuing the supply of fuel to the cylinder associated with the one of the crankcase chambers upon the sensing of an abnormal condition by the abnormal condition sensing means.

In accordance with an apparatus performing another feature of the invention, means are provided for controlling the amount of fuel supplied to the cylinders by a different method when the abnormal condition sensing means senses an abnormal condition.

A method of the invention consists of the discontinuing of the supply of fuel to the cylinder associated with the one of the crankcase chambers upon the sensing of an abnormal condition by the abnormal condition sensing means.

Another method in accordance with the invention, comprises the step of controlling the amount of fuel supplied by the charge forming device by a means other than the crankcase pressure sensor in response to the sensing of an abnormal condition by the abnormal condition sensing means.

DETAILED DESCRIPTION OF THE PREFERRED EMBODIMENTS OF THE INVENTION

Figure 1:
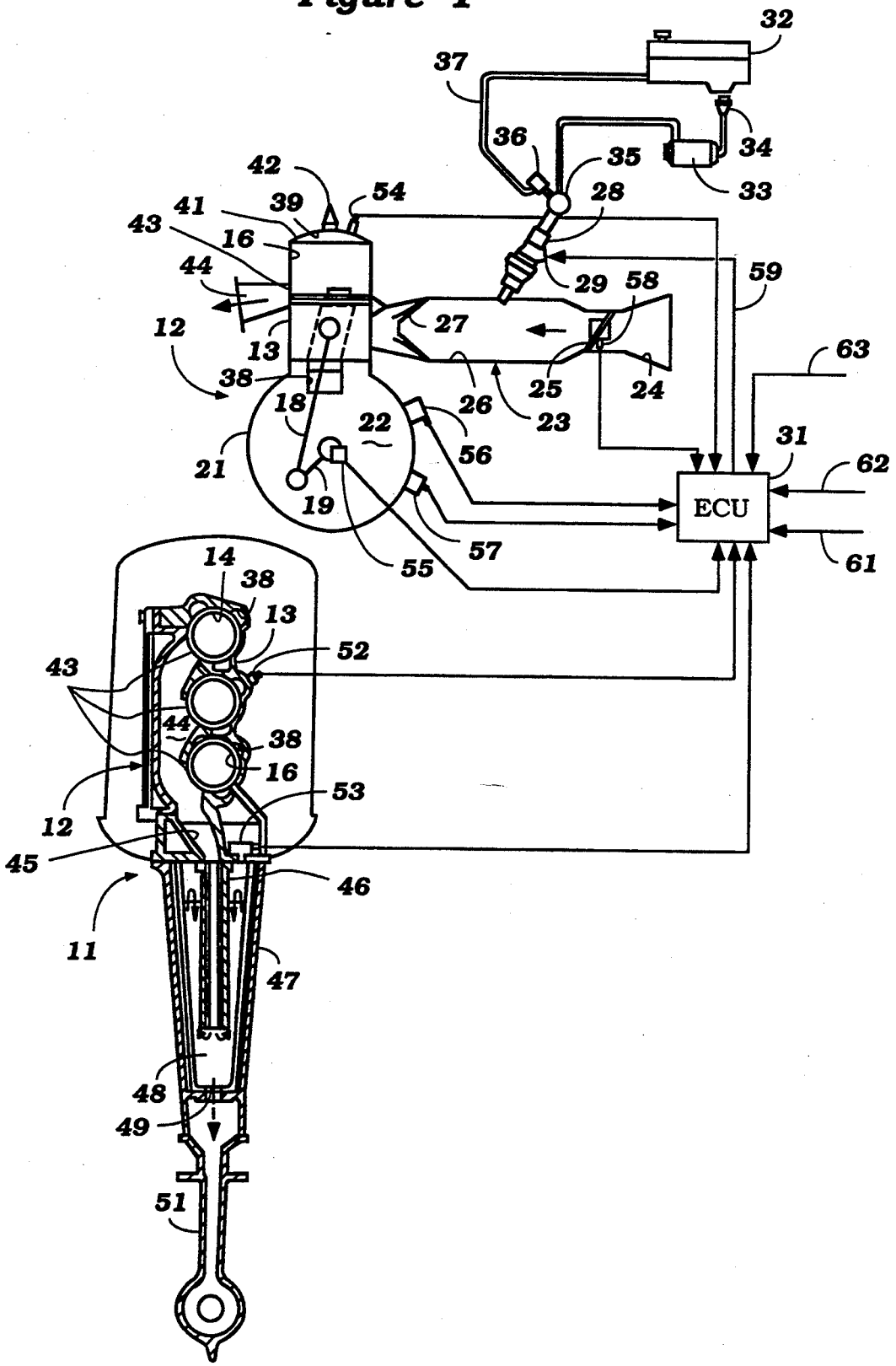
FIG. 1 is a composite view from the rear of an outboard motor constructed in accordance with an embodiment of the invention, with portions shown in section, and a single cylinder of the engine shown taken along a horizontal plane with the associated control shown schematically.

Referring now in detail to the drawings, an outboard motor constructed in accordance with an embodiment of the invention is identified generally by the reference numeral 11. The invention is described in conjunction with an outboard motor as a typical environment in which the invention, which relates to an internal combustion engine, may be employed. This is because the invention deals primarily with a fuel control system for a two cycle, crankcase compression, multiple cylinder engine and such engines are normally employed in outboard motors. It should be readily apparent to those skilled in the art, however, that the invention is capable of use in other applications for such engines.

The outboard motor 11 includes an internal combustion engine, indicated generally by the reference numeral 12 which, as has already been noted, is of the two cycle, multi cylinder, crankcase compression type. The engine in the illustrated embodiment includes a cylinder block 13 that is formed with three aligned cylinder bores 14, 15 and 16. Although the invention is described in conjunction with a three cylinder, in-line type engine, the invention may be practiced with engines having other numbers of cylinders and other cylinder configurations.

A piston 17 is slidably supported in each of the cylinder bores 14, 15 and 16 and is connected by means of a respective connecting rod 18 to a crankshaft 19. As is typical with outboard motor practice, the crankshaft 19 is supported so that it rotates about a vertically extending axis.

The crankshaft 19 is journalled in any known manner in a crankcase assembly that is comprised of the cylinder block 13 and a crankcase member 21 that is affixed to the cylinder block 13 in any well known manner. The crankshaft 19 rotates in chambers of the crankcase thus formed and in accordance with conventional two cycle, crankcase compression practice, each crankcase chamber associated with the respective cylinder bores 14, 15 and 16 is sealed from each other in a well known manner. The crankcase chamber 22 associated with the cylinder bore 16 is depicted because this is the cylinder where a pressure sensor, to be described, for measuring intake air flow is positioned.

An induction system, indicated generally by the reference numeral 23 is provided for supplying a fuel/air charge to the individual crankcase chambers 22 associated with each of the cylinder bores 14, 15 and 16. This induction system includes an air inlet 24 that cooperates with an intake air silencer of any known type and in which a flow controlling throttle valve 25 is positioned. A plurality of individual runners 26 extend from the throttle valve 25 to the respective crankcase chambers 22 through a porting system in which reed type check valves 27 are provided. The check valves 27 permit air flow to the individual crankcase chambers 22 during upward movement of the pistons 17, but preclude reverse flow when the pistons 17 are moving downwardly so as to compress the charge in the crankcase chambers A charge forming system is also provided so as to supply fuel for the engine operation and in the illustrated embodiment, this charge forming system includes a plurality of fuel injectors 28, only one of which is shown in the drawings, but each of which communicate with the manifold runner 26 associated with the respective crankcase chamber 22. In the illustrated embodiment, the fuel injectors 28 are depicted as being of the electrically operated type and have a solenoid terminal 29 which receives electrical power under the control of an ECU 31 for spraying fuel into the manifold runners 26.

The fuel system further includes a remotely positioned fuel tank 32 from which fuel is drawn by a pump 33 and conduit in which a filter 34 is positioned. A manifold or fuel rail 35 is connected to the fuel injectors 28 and the pressure of fuel supplied to each of the injectors 28 is controlled by a pressure relief valve 36 which controls pressure by dumping fuel back to the tank 32 through a return line 37.

The charge which is compressed in the crankcase chambers 22 is transferred to the cylinder bores 14, 15 and 16 above the pistons 17 through one of more scavenge passages 38 in any desired scavenging arrangement. This charge is then further compressed in a combustion chamber 39 formed by a cylinder head 41 that is affixed to the cylinder block 13 in a known manner, the cylinder bores 14, 15 and 16, respectively, and the respective pistons 17. The thus further compressed charge is then fired by means of a spark plug 42 in a known manner.

Exhaust ports 43 are formed in the cylinder block 13 and extend from the cylinder bores 14, 15 and 16 to an exhaust manifold 44 formed integrally within the cylinder block 13. This exhaust manifold 44 communicates with an exhaust outlet 45 that extends through the lower face of the cylinder block 13 and which communicates with an exhaust pipe 46 that depends into a drive shaft housing 47 of the outboard motor 11, as is typical with outboard motor practice.

An expansion chamber 48 is formed within the drive shaft housing 47 and the exhaust gases are silenced by their expansion into the expansion chamber 48 and are then discharged downwardly through a discharge passage 49 into a lower unit 51 which has a suitable underwater high speed exhaust gas discharge, as is well known in this art. As is also well known, the outboard motor 11 may be provided with a more restricted above-the-water exhaust gas discharge for discharging the exhaust gases when the associated watercraft is either idling or traveling at a low speed and the lower unit 51 and drive shaft housing 47 are submerged to an extent that the exhaust gases could not easily exit the underwater high speed exhaust gas outlet.

The construction of the outboard motor as thus far described may be considered to be conventional and, for that reason, only those components which are necessary to understand the construction and operation of the invention have been illustrated and described in any detail. Where any component has not been described, it may be considered to have a conventional construction.

The invention deals with the control for the fuel injectors 28 and the operation of the ECU 31. This system will now be described by continued reference to FIG. 1. The ECU 31 receives a number of signals from the engine and of ambient conditions and these signals include an engine temperature signal supplied from an engine temperature sensor 52 that is mounted in the cylinder block 13 in proximity to the scavenge passage of the engine. In addition, a back pressure or exhaust system pressure sensor 53 is mounted that communicates with the expansion chamber 48 and provides a signal to the ECU 31 indicative of exhaust back pressure.

The pressure in the combustion chambers 39 is sensed by a pressure sensor 54 which also outputs its signal to the ECU 31.

A crankshaft angle sensor 55 is positioned in proximity to the crankshaft 19 and outputs a signal indicative of both crankshaft angle and engine speed to the ECU 31. There is also provided a crankcase pressure sensor 56 that senses the pressure in the crankcase chamber 22 associated with the cylinder bore 15 only. As has been previously noted, this pressure sensor 56 sends a signal to the ECU 31 which can be utilized to compute intake air flow by measuring the pressure at certain timings with respect to the opening and closing of the scavenge passages 38. There is also provided an intake air temperature sensor 57 that senses the temperature of the air that is inducted to the crankcase chambers.

A further engine condition sensor comprises a throttle position sensor 58 that outputs a signal to the ECU 31 indicative of the position of the throttle valve 25. It is to be understood that the aforenoted engine condition sensors are just some of the type sensors which can be employed for engine control and it should be remembered that the ECU 31 not only controls the input to the solenoid terminal 29 of the fuel injectors 28 through a control line 59, but also controls the firing of the spark plugs 42. The number and types of sensors employed may vary depending upon specific application and two different types of control routines employing certain types of these sensors will be described later by reference to FIGS. 2 and 3.

One further engine sensor may be provided and this is a vibration sensor (not shown) that inputs a signal indicated by the line 61 to the ECU 31 to indicate engine vibrations and/or knocking conditions.

There are also provided in addition to those engine sensors, certain sensors of ambient conditions and these can include a temperature sensor 62 that senses the temperature of the cooling water delivered to the cooling jacket of the engine 12 and an air pressure sensor 63 that senses atmospheric air pressure. Like those engine sensors, various types of ambient conditions may be used in the control strategy in addition to those described.

A first type of control routine for dealing with conditions when the crankcase pressure sensor 56 may not provide an accurate indication of air flow or when the crankcase pressure sensor 56 requires protection will be described by particular reference to FIG. 2. It should be noted that the control routine of FIG. 2 operates on the principal that an abnormal condition of the engine exist when the throttle angle Th8 is relatively small as this is a condition when backfiring into the crankcase chambers can occur due to the overlap between the opening of the scavenge port prior to closure of the exhaust port. The selected throttle angle for this condition will be described.

When this condition is sensed to be present, the amount of fuel supplied to the injector 28 for the cylinder bore with which the pressure sensor 56 is associated, the cylinder bore 16 in this embodiment, is stopped. This is done for only a single revolution or a relatively low number of revolutions and the fuel injection amount in accordance with embodiment for the remaining cylinders is set by the output from the pressure sensor 56.

Referring specifically to this program, the program starts and moves to the step S-1 so as to read the engine speed N. The program then moves to the step S-2 so as to read the selected crankcase pressure $P_{AVE}$ at the respective crankshaft angle positions relating to the opening and closing of the scavenge port, as aforenoted. The program then moves to the step S-3 so as to read the angle of the throttle valve 25 by the throttle position sensor 58.

The program then moves to the decision step of S-4 so as to determine if the abnormal condition is present or not. This is done by determining if the opening of the throttle valve is less than or equal to 3° for the aforenoted reasons ($Th\theta \leqq 3°$). If the throttle opening is determined to be equal to or less than 3° at the step S-4 ($Th\theta \geqq 3°$), then an abnormal condition is determined and a flag is set at the step S-5. If, however, at the step S-4 it is determined that the throttle opening is greater than 3°, then the program moves to the step S-6 so as to clear any flag which may have been previously set.

The program then moves to the step S-7 regardless of whether the flag has been set at the step S-5 or a flag has been cleared at the step S-6 wherein the basic fuel injection amount F is read from a map. This amount is calculated by taking the instant pressure readings in the crankcase and averaging it with the previous three readings and reading from a map the amount of fuel flowing from to the engine for this pressure average and for the given speed N at which the engine is operating.

The program then moves to the step S-8 so as to apply a correction factor C which will depend upon sensed conditions such as temperature, etc. so as to correct the fuel injection amount $F' = F \times C$. The program then moves to the step S-9 so as to set the fuel injection amount for cylinder number 1 $F_1'$ which in this embodiment, is equal to $F'(F_1' = F')$. This is the fuel injector for the cylinder bore 14. The program then moves to the step S-10 so as to set the amount of fuel injection for the next cylinder, cylinder 15 in the embodiment, which again is the same ($F_2' = F'$).

The program then moves to the decisional step S-11 wherein the condition of the flag is determined. If there is no flag set, the program then moves to the step S-12 so as to also set the fuel injection amount of the number three cylinder, cylinder bore 16, in accordance with the normal control routine in this embodiment, ($F_3' = F'$). After this, the program repeats.

If, however, at the step S-11 it has been determined that the flag has been set because of the existence of abnormal condition, in this case the throttle opening being 3° or less, the program determines to skip fuel injection for the cylinder associated with the crankcase pressure sensor, the cylinder 16 in this embodiment, and the program then skips the step S-12 and again repeats.

Figure 3:
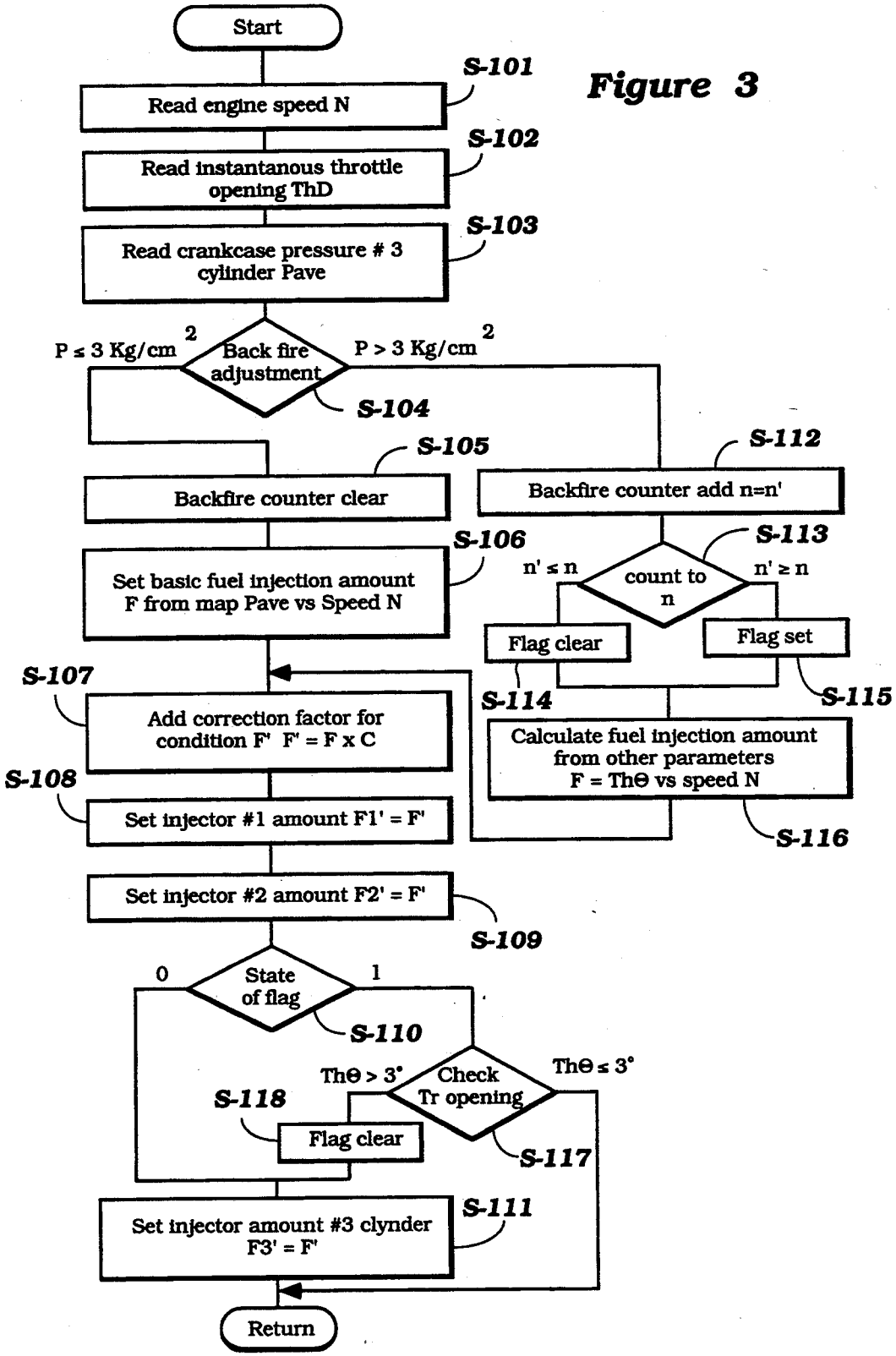
FIG. 3 is a block diagram of another control routine in accordance with the invention.

In the control routine as thus far described, it will be seen that the fuel injection amount for the cylinder with which the sensor is associated, will be decreased to zero in the event of an abnormal condition. However, the fuel injection amounts of the remaining cylinders will be set by the output from this sensor. FIG. 3 shows another control routine wherein the program not only stops the fuel injection for the cylinder associated with the crankcase pressure sensor in the event of an abnormal condition, but also makes a calculation for the fuel injection amounts for the remaining cylinders on a different basis when that occurs. Also, in this embodiment the condition of backfiring is determined whether or not there is an actual backfire by reading the pressure in the crankcase chamber. If the crankcase chamber pressure is greater than a predetermined amount, such as three kilograms per square centimeter (3 kg/cm) just before the scavenge port is opened, it is assumed that a backfire has happened.

Referring now in detail to FIG. 3, when this program starts it moves to the step S-101 so as to read the engine speed N. The program then moves to the step S-102 to read the instantaneous opening degree of the throttle valve ThD. The program then moves to the step S-103 to read the pressure ($P_{AVE}$) in the crankcase chamber where the pressure sensor is, in this case that associated with number three cylinder, cylinder bore 16.

The program then moves to the step S-104 so as to make a determination as to whether or not there is a backfire condition. This is determined by comparing the pressure in the crankcase chamber immediately before scavenge port opening with a predetermined maximum pressure such as 3 kilograms per square centimeter. If the pressure is less than or equal to 3 kilograms per square centimeter ($P \leqq 3$ kg/cm$^2$), the program then moves to the normal control routine steps which will now be described.

In this normal control routine, the program moves to the step S-105 so that the condition of the backfire flag will not be changed and the backfire counter is reset. The program then moves to the step S-106 so as to set the basic fuel injection amount F from the information received from the pressure sensor in accordance with a map dependent upon the pressure average and the engine speed.

The program then moves to the step S-107 so as to correct the basic fuel injection amount F so as to correct for other conditions such as ambient temperature, pressure, etc. in accordance with the relationship $F' = F \times C$, where C is the correction factor programmed into the system.

The program then moves to the step S-108 so as to set the fuel injection amount for the number one injector associated with cylinder bore 14 in accordance with the relationship $F_1' = F'$. A similar procedure is done for the number two injector associated with cylinder bore 15 at step S-109 wherein $F_2' = F'$.

The program then moves to the step S-110 so as to make a determination as to the setting of the number three cylinder fuel injection amount by determining the state of the backfire flag. If the backfire flag is not set, the program skips to the step S-111 so as to set the normal fuel injection amount for cylinder number three (cylinder bore 16) in accordance with the relationship $F_3' = F'$. The program then returns.

If at the step S-104 it has been determined that there is a backfire or abnormal condition because the pressure of the pressure sensor 56 has indicated a pressure greater than 3 kilograms per square centimeter (3 kg/cm$^2$), the program moves to the routine wherein the backfire flag may be set at the step S-112.

The program then moves to the step S-113 to determine if a predetermined number of backfires have occurred. The program does not immediately assume an abnormal condition unless there are more than a predetermined number of backfire signals received. Hence, the program then moves to the step S-113 to determine if the number of the counter n' is less than or greater than the predetermined number of counts n ($n' < n$ or $n' \geqq n$). If the value is less than the predetermined number of successive. backfires, the program moves to the step S-114 so as to clear the flag.

If, however, the counter equals or exceeds the n, the program moves to the step S-115 so as to set the backfire flag. The program then moves to the step S-116 so as to calculate the fuel injection amount from factors other than the output from the pressure sensor, in this case from the throttle valve opening and the engine speed (The$\theta$vs and N). The program then moves to the step S-107 so as to apply the necessary correction factors to obtain the fuel objection amount F' from this date and continues through to the step S-110.

If, at the step S-110 it is determined that the flag is up, then the program moves to a sequence for determining if the fuel injection for cylinder number three (cylinder bore 16) should be stopped. This is done at the step S-117 wherein the throttle valve opening taken at the step S-102 is checked. If the throttle valve opening is greater than 3°, then it is assumed that conditions are acceptable for injecting fuel into this cylinder and the program moves to the step S-118 so as to clear the flag and set the fuel injection amount at the step S-111 as with the normal routine.

If, on the other hand, at the step S-117 it is determined that the throttle valve opening is less than or equal to 3°, then no fuel injection will be accomplished in the cylinder bore 16 and the program will repeat from this step back to the start.

Figure 2:
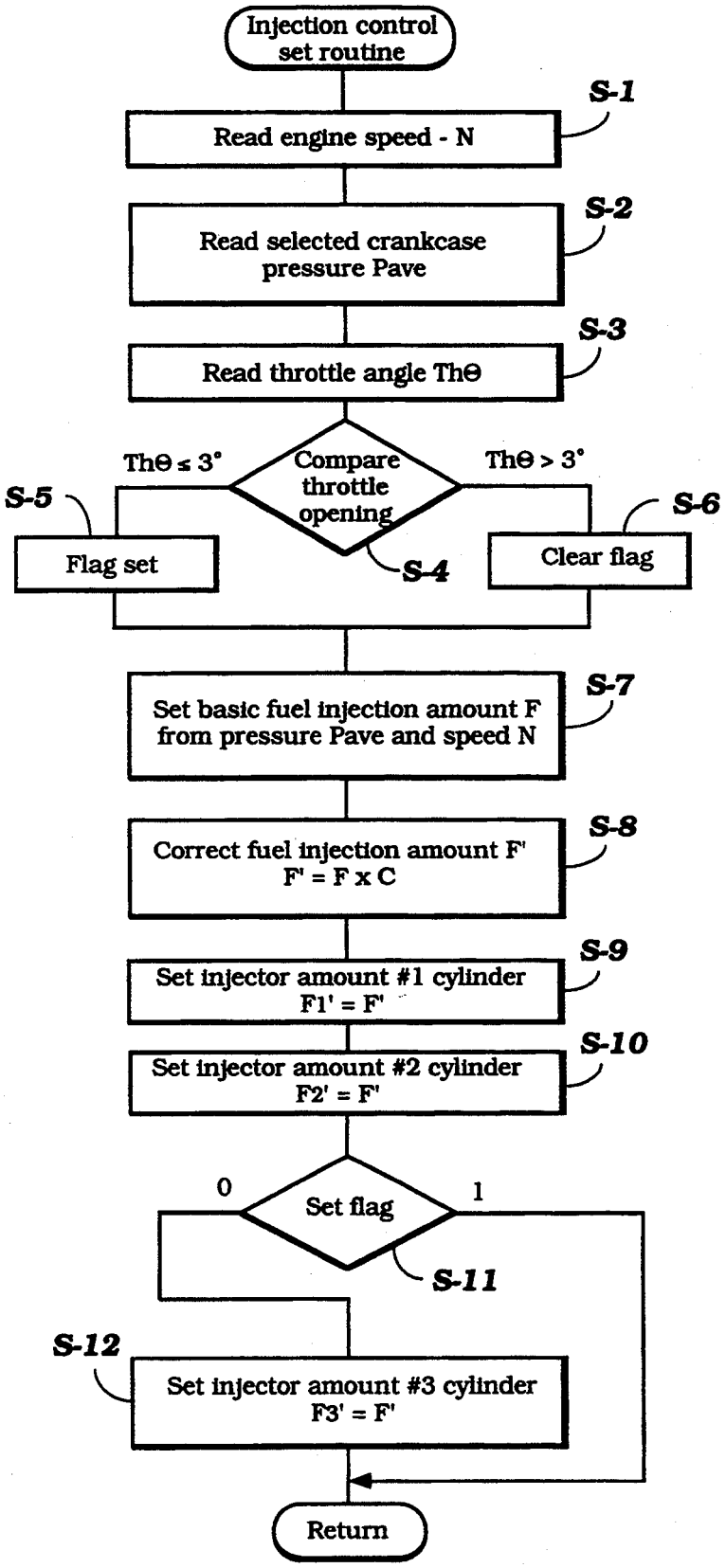
FIG. 2 is a block diagram showing one control routine in accordance with the invention.

Thus, with this embodiment there is the safeguard as with the previously described embodiment, but it is also possible to set the fuel injection amounts for the cylinders other than those associated with the crankcase pressure sensor by something other than the output pressure from the crankcase pressure sensor as was previously the case with the embodiment of FIG. 2.

It should be readily apparent from the foregoing description that the described embodiments of the invention are very effective in providing good fuel injection control through a single pressure sensor for a multiple cylinder engine, but it is also insured that the crankcase pressure sensor will be protected from abnormal conditions and when abnormal conditions occur, that accurate fuel injection is supplied to tile other cylinders. The abnormal condition sensed has been determined by crankcase pressure and/or throttle valve opening, but it is understood that other types of sensors can be employed for sensing the backfiring condition such as either a knock sensor or the combustion chamber pressure sensor of one cylinder such as the sensor 54 in the illustrated embodiment. Of course, various other changes and modifications may be made without departing from the spirit and scope of the invention as defined by the appended claims.

I claim:

1. A two stroke, crankcase compression, internal combustion engine having a cylinder block with at least two cylinder bores, a crankcase associated with said cylinder bores and having at least two crankcase chambers each associated with a respective one of said cylinder bores and sealed from each other, charge forming means for supplying a fuel charge to said cylinders, a crankcase pressure sensor associated with only one of said crankcase chambers for sensing the pressure therein, means responsive to the output of said crankcase pressure sensor for controlling the amount of fuel supplied to each of said cylinder bores, abnormal condition sensing means for sensing an abnormal condition which may affect the operation of said pressure sensor, and means for discontinuing the supply of fuel to the cylinder associated with said one of said crankcase chambers upon the sensing of an abnormal condition by said abnormal condition sensing means.

2. A two stroke, crankcase compression, internal combustion engine as set forth in claim 1 wherein fuel is supplied to the other cylinder when the supply of fuel to the cylinder associated with the one of the crankcase chambers is discontinued.

3. A two stroke, crankcase compression, internal combustion engine as set forth in claim 2 wherein the supply of fuel to the other cylinder is controlled by a means different than the output of the crankcase pressure sensor when the supply of fuel to the cylinder associated with the one crankcase chamber is discontinued.

4. A two stroke, crankcase compression, internal combustion engine as set forth in claim 1 wherein the abnormal condition sensing means senses when a throttle valve associated with the engine is not opened more than a predetermined degree.

5. A two stroke, crankcase compression, internal combustion engine as set forth in claim 4 wherein fuel is supplied to the other cylinder when the supply of fuel to the cylinder associated with the one of the crankcase chambers is discontinued.

6. A two stroke, crankcase compression, internal combustion engine as set forth in claim 1 wherein the abnormal condition sensing means senses a pressure in the crankcase chamber which is greater than a predetermined pressure.

7. A two stroke, crankcase compression, internal combustion engine as set forth in claim 6 wherein fuel is supplied to the other cylinder when the supply of fuel to the cylinder associated with the one of the crankcase chambers is discontinued.

8. A two stroke, crankcase compression, internal combustion engine as set forth in claim 7 wherein the supply of fuel to the other cylinder is controlled by a means different than the output of the crankcase pressure sensor when the supply of fuel to the cylinder associated with the one crankcase chamber is discontinued.

9. A two stroke, crankcase compression, internal combustion engine as set forth in claim 8 wherein the amount of fuel supplied to the other cylinder is determined by the opening of the throttle valve of the engine and the speed of the engine.

10. A two stroke, crankcase compression, internal combustion engine as set forth in claim 1 wherein the charge forming means comprises a fuel injector.

11. A two stroke, crankcase compression, internal combustion engine as set forth in claim 10 wherein is there is provided a separate fuel injector for each cylinder.

12. A method of operating a two stroke, crankcase compression, internal combustion engine having a cylinder block with at least two cylinder bores, a crankcase associated with said cylinder bores and having at least two crankcase chambers each associated with a respective one of said cylinder bores and sealed from each other, charge forming means for supplying a fuel charge to said cylinders, a crankcase pressure sensor associated with only one of said crankcase chambers for sensing the pressure therein, means responsive to the output of said crankcase pressure sensor for controlling the amount of fuel supplied to each of said cylinder bores, said method comprising the steps of sensing an abnormal condition which may affect the operation of said pressure sensor, and discontinuing the supply of fuel to the cylinder associated with said one of said crankcase chambers upon the sensing of an abnormal condition by said abnormal condition sensing means.

13. A method as set forth in claim 12 wherein fuel is supplied to the other cylinder when the supply of fuel to the cylinder associated with the one of the crankcase chambers is discontinued.

14. A method as set forth in claim 13 wherein the supply of fuel to the other cylinder is controlled by a means different than the output of the crankcase pressure sensor when the supply of fuel to the cylinder associated with the one crankcase chamber is discontinued.

15. A method as set forth in claim 12 wherein the abnormal condition is sensed when a throttle valve associated with the engine is not opened more than a predetermined degree.

16. A method as set forth in claim 15 wherein fuel is supplied to the other cylinder when the supply of fuel to the cylinder associated with the one of the crankcase chambers is discontinued.

17. A method as set forth in claim 12 wherein the abnormal condition comprises a pressure in the crankcase chamber which is greater than a predetermined pressure.

18. A method as set forth in claim 17 wherein fuel is supplied to the other cylinder when the supply of fuel to the cylinder associated with the one of the crankcase chambers is discontinued.

19. A method as set forth in claim 18 wherein the supply of fuel to the other cylinder is controlled other than by the output of the crankcase pressure sensor when the supply of fuel to the cylinder associated with the one crankcase chamber is discontinued.

20. A method as set forth in claim 19 wherein the amount of fuel supplied to the other cylinder is determined by the opening of a throttle valve of the engine and the speed of the engine.

21. A method as set forth in claim 12 wherein the charge forming means comprises a fuel injector.

22. A method as set forth in claim 21 wherein is there is provided a separate fuel injector for each cylinder.

23. A two stroke, crankcase compression engine having a cylinder block with at least two cylinder bores, a crankcase associated with said cylinder bore and having at least two crankcase chambers each associated with a respective one of said cylinder bores and sealed from the others, charge forming means for supplying a fuel charge to said cylinders, a crankcase pressure sensor associated with only one of said crankcase chambers for sensing the pressure therein, means responsive to the output of said crankcase pressure sensor for controlling the amount of fuel supplied to each of said cylinder bores, abnormal condition sensing means for sensing an abnormal condition which may affect the operation of said pressure sensor, and means for controlling the supply of fuel to the cylinder other than the cylinder associated with the one of the cylinders in response to other conditions when the abnormal condition sensing means senses an abnormal condition.

24. A two stroke, crankcase compression engine as set forth in claim 23 wherein fuel is supplied only to the other cylinder when the abnormal condition is sensed.

25. A two stroke, crankcase compression engine as set forth in claim 24 wherein the abnormal condition sensed is a backfire condition.

26. A two stroke, crankcase compression engine as set forth in claim 25 wherein the supply of fuel to the cylinder associated with the one of the crankcase chambers is discontinued when the abnormal condition is sensed.

27. A method of operating a two stroke, crankcase compression engine having a cylinder block with at least two cylinder bores, a crankcase associated with said cylinder bore and having at least two crankcase chambers each associated with a respective one of said cylinder bores and sealed from the others, charge forming means for supplying a fuel charge to said cylinders, a crankcase pressure sensor associated with only one of said crankcase chambers for sensing the pressure therein, means responsive to the output of said crankcase pressure sensor for controlling the amount of fuel supplied to each of said cylinder bores, said method comprising the steps of sensing an abnormal condition which may affect the operation of said pressure sensor, and controlling the supply of fuel to the cylinder other than the cylinder associated with the one of the cylinders in response to other conditions when the abnormal condition sensing means senses an abnormal condition.

28. A method as set forth in claim 27 wherein fuel is supplied only to the other cylinder when the abnormal condition is sensed.

29. A method as set forth in claim 28 wherein the abnormal condition sensed is a backfire condition.

30. A method as set forth in claim 29 wherein the supply of fuel to the cylinder associated with the one of the crankcase chambers is discontinued when the abnormal condition is sensed.

* * * * *